United States Patent [19]

Steinhilber

[11] Patent Number: 4,632,379

[45] Date of Patent: Dec. 30, 1986

[54] DEVICE FOR FEEDING INDIVIDUAL SHEETS TO AN OFFICE MACHINE

[76] Inventor: Friedhelm Steinhilber, Saline 29, D - 7210 Rottweil, Fed. Rep. of Germany

[21] Appl. No.: 746,794

[22] Filed: Jun. 20, 1985

[30] Foreign Application Priority Data

Jun. 20, 1984 [DE] Fed. Rep. of Germany ..... 3422794

[51] Int. Cl.[4] ..... B65H 1/08; B65H 7/04

[52] U.S. Cl. ..... 271/127; 271/110; 271/111; 271/160; 271/258

[58] Field of Search ..... 271/22, 24, 30.1, 31.1, 271/110, 111, 126–129, 147, 149, 157, 160, 164, 162, 258, 259

[56] References Cited

U.S. PATENT DOCUMENTS 3,907,283 9/1975 Miller ..... 271/258
4,212,456 7/1980 Ruenzi ..... 271/127
4,231,566 11/1980 Suzuki ..... 271/164
4,319,741 3/1982 Okamato ..... 271/127
4,508,332 4/1985 Nishio ..... 271/127

*Primary Examiner*—George E. A. Halvosa
*Assistant Examiner*—James E. Barlow
*Attorney, Agent, or Firm*—Eric P. Schellin

[57] ABSTRACT

In a device for feeding individual sheets to an office machine, in which a stack of sheets stored in a magazine is pressed by a pressure plate (22) against a separating device (20), a switch (30) which is actuated by a lever is provided on the rear of the pressure plate (22). The lever extends through the pressure plate (22) with one arm (36) in order to determine the presence of paper sheets in the magazine. The other arm (38) is actuated by a stop when the pressure plate (22) is moved away from the separating device (20). This causes the switch (30) to indicate whether the device is ready for operation.

3 Claims, 3 Drawing Figures

DEVICE FOR FEEDING INDIVIDUAL SHEETS TO AN OFFICE MACHINE

BACKGROUND OF THE INVENTION

Device for feeding individual sheets to an office machine, with a magazine for receiving a stack of sheets, with a separating device which catches the first sheet of the stack, with a movably mounted pressure plate which rests against the back of the stack under the action of force and presses it against the separating device, and with a switch which is located behind the pressure plate, controls the device and/or the office machine and is actuated by a part extending through the pressure plate when at least one sheet is present in the magazine.

In a device of this type known from DE-OS No. 27 11 173 the stack of individual sheets stored in the magazine of the device is pressed by a pivotably mounted pressure plate under spring action against a separating device which is constructed as a roller which makes frictional contact with the first sheet of the stack. The separating roller is driven as needed in order to draw the first sheet from the stack and feed it to the platen of the office machine. A microswitch is attached behind the pressure plate in the device which extends with a leaf spring through the pressure plate. The sheet stack resting on the pressure plate forces the leaf spring down, therewith actuating the microswitch. The microswitch controls the device in such a manner that the device can only be put in operation when it is actuated. If there is no longer a sheet in the magazine, the microswitch is no longer actuated and the device is stopped until a new sheet stack is set into the magazine.

In order to set a new sheet stack into the magazine, the pressure plate must be pivoted away from the separating roller against the spring action and must be held in this pivoted-away position. This is cumbersome for the operation. A device of the type initially mentioned is therefore known which provides for a catching of the pressure plate in the position moved away from the separating device in order to be able to easily set a new sheet stack into the magazine. If one forgets to release the catch in this device after the new paper stack has been set in, the switch is actuated be the set stack, so that the device can be put back in operation. However, since the pressure plate is kept in a position pivoted away from the separating device by the catch, the pressure plate does not press the stack against the separating device, so that it does not catch the stack and can not feed a sheet.

The invention has the task of improving a device of the type initially mentioned in such a manner that this device can only be put in operation if not only paper sheets are present in the magazine, but also if it has been established that the pressure plate is pressing these paper sheets against the separating device.

SUMMARY OF THE INVENTION

The invention solves this task by providing a second switch which controls the device and/or the office machine in the same manner as the first switch and which is actuatable by the movement of the pressure plate away from the separating device (separating rollers). Advantageous embodiments and improvements of the invention are indicated in the subclaims.

The second switch provided in accordance with the invention is actuated when the pressure plate is moved away from the separating device in order to set a new paper stack in the magazine and especially when the pressure plate catches at the end of its travel opposite the separating device. The actuation of the second switch signals that the pressure plate is not pressing against the separating device, so that the separating device is not effectively catching the uppermost sheet of the paper stack stored in the magazine. Both switches signal therewith that the device is not operable, the first switch because no paper is present in the magazine and the second switch because the paper stack is not pressed against the separating device. Both switches are used in the same manner to interrupt the operation of the device or of the office machine if the single-sheet feed is not ready to operate. In as far as the device for feeding the individual sheets comprises its own drive, this drive can be stopped or put in operation by the control of the switches. If the device is driven via the platen of the office machine, the drive can be cut on or off by the office machine corresponding to the signal of the switches.

DETAILED DESCRIPTION OF THE INVENTION

The second switch can either be attached to the back side of the pressure plate, so that its contact is actuated when the switch strikes a stop positioned at the end of the travel of the pressure plate. Or, the second switch can also be positioned in a fixed manner in the device at the end of the travel of the pressure plate, so that its contact is actuated by the pressure plate when the plate is moved completely away from the separating device.

An embodiment which is particularly advantageous as concerns the expense consists in that both switches are united in a single switch which is attached to the back of the pressure plate. In this embodiment the switch is actuated by a lever which extends on the one hand through the pressure plate and thus scans the presence of paper sheets in the magazine and makes contact on the other hand with a stop when the pressure plate is completely moved away from the separating device. In this embodiment only a single switch is necessary, which controls the device and/or the office machine. The lever can be constructed in various ways. The only essential feature is that the lever brings the switch into the same switching position on the one hand when the paper stacked in the magazine shifts the part of the lever extending through the pressure plate and on the other hand when the lever is shifted at the end of the travel of the pressure plate by the stop.

In a preferred embodiment the lever is a two-armed lever which is pivotably mounted in the switch. The one lever arm extends through the pressure plate and the other lever arm makes contact with the stop. A contact tongue connected to the switching pole is moved back and forth by the lever between the contacts which are connected to one another and form the other switching pole. If no paper sheet is in the magazine, the one lever arm can extend completely through the pressure plate and the lever is in its one end position of the pivot movement in which it does not touch the contact tongue, so that the contact tongue rests on the one contact of the contact pair. The switch is thus closed and signals that the device is not ready to operate.

If a stack of paper is in the magazine, this stack presses this first lever arm back to the plane of the pressure plate. The lever makes contact with the contact tongue thereby and lifts it off the contact, so that it is located between the two contacts of the contact pair. The switch is open, so that the device is ready for operation. If the pressure plate is pivoted away from the separating device, the other lever arm makes contact with the stop and the lever is pivoted further into its other end position. In this end position the lever presses the contact tongue into contact with the other contact of the contact pair, the switch is closed again and likewise signals that the device is not operational.

DETAILED DESCRIPTION OF THE DRAWING

The invention is described in more detail below with reference made to an embodiment shown in the drawings.

Figure 1:
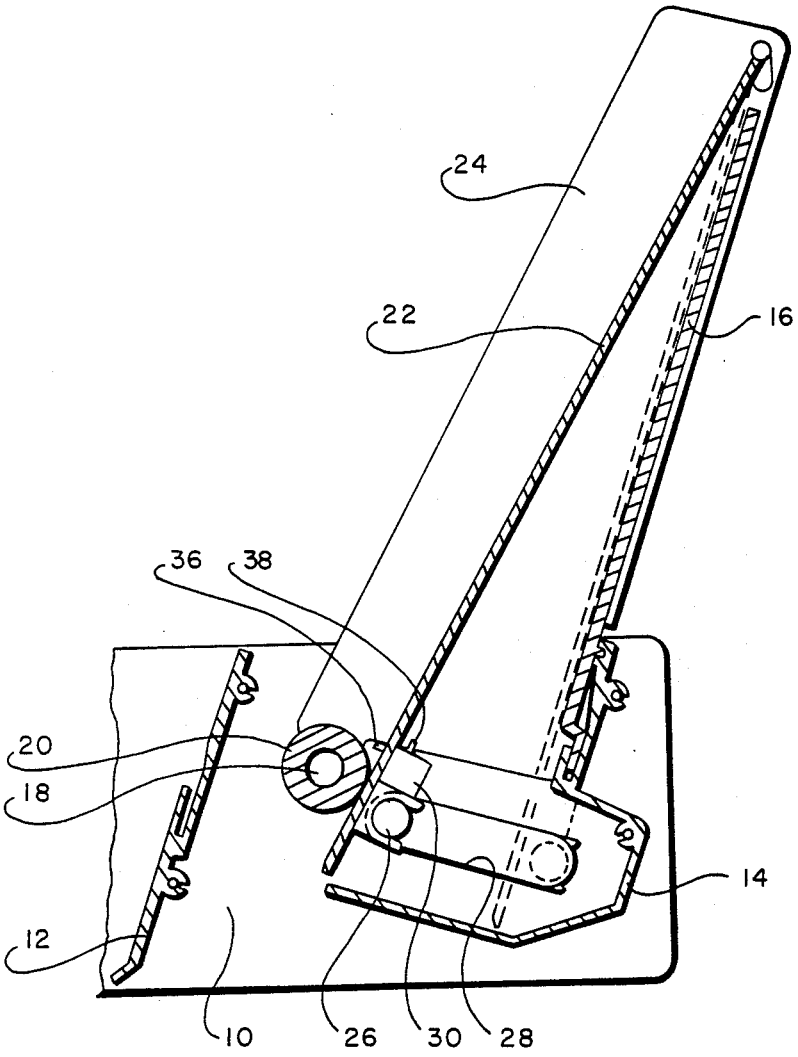
FIG. 1 shows a vertical section of the device.

The device comprises two side walls 10 which are connected by profiles 12 and 14. Rear wall 16 is set into rear profile 14. Through shaft 18 is mounted in side walls 10, on which one or several friction separating rollers 20 are carried. Shaft 18 and with it separating rollers 20 is driven via the office machine (not shown) or via a drive of the device itself in a clockwise direction (FIG. 1).

A stack of individual sheets is set standing essentially vertically on the horizontal lower section of profile 14 and rests against pressure plate 22. Pressure plate 22 is pivotably mounted with its upper end in side part 24 held by rear wall 16. Pressure plate 22 is snapped onto transversal shaft 26 at its lower end. Transversal shaft 26 is shiftably guided in side walls 10 of the device in essentially horizontal slots 28, so that pressure plate 22 can be pivoted between the solid-line position shown in FIG. 1, in which it rests against separating rollers 20, and a position which is pivoted away from separating rollers 20, shown in dotted lines in FIG. 1. A traction spring which is not shown in the drawings and which engages transversal shaft 26 holds pressure plate 22 against separating rollers 20. Transversal shaft 26 and with it pressure plate 22 can be moved away from separating rollers 20 by means of a lever against the force of this traction spring, whereby a lever can catch in the dottedline position shown for transversal shaft 26 and pressure plate 22 in order to keep them pivoted away from separating rollers 20.

In order to set a stack of paper sheets into the magazine, pressure plate 22 is pivoted away from the separating rollers and caught in the position shown in dotted lines. The paper stack can now be set in, so that it rests on the lower horizontal part of profile 14. Then, the catch of the lever is released and pressure plate 22 is drawn by the action of the traction spring engaging on transversal shaft 26 against separating roller 20. This causes the paper stack to be pressed by pressure plate 22 against separating rollers 20 and when separating rollers 20 are driven, the uppermost sheet is drawn down off the stack and fed to the platen of the office machine.

Figure 2:
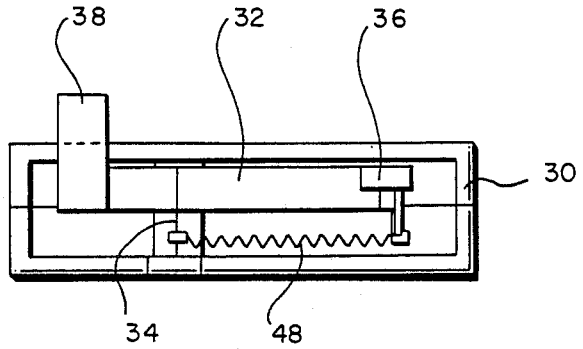
FIG. 2 shows a front view of the switch viewed from the pressure plate.
Figure 3:
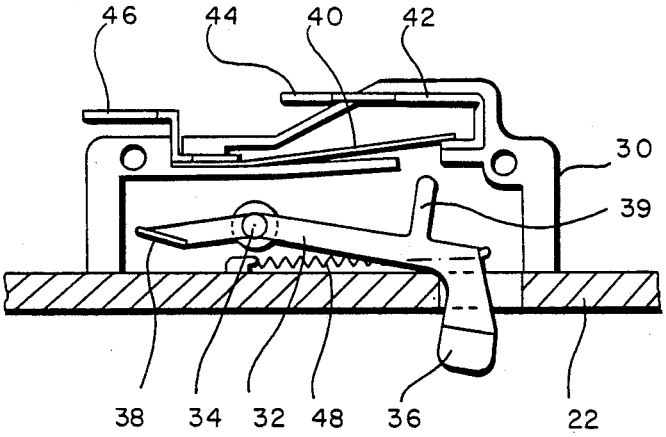
FIG. 3 shows a top view of the switch, whereby part of the switch housing has been removed.

Switch 30, which is shown on an enlarged scale in FIGS. 2 and 3, is attached in the lower area of pressure plate 22 to its rear side.

Switch 30 comprises two-armed lever 32 which can pivot about vertical shaft 34 parallel to pressure plate 22. The one arm 36 of lever 32 is bent in the pivot plane toward pressure plate 22 and extends through an opening of pressure plate 22. The other arm 38 of lever 32 is bent upward vertical to the pivot plane and extends upward out of the housing of switch 30 through a slot vertical to pressure plate 22.

Projection 39 extends from lever 32 in its pivot plane opposite to arm 36. Contact tongue 40, which forms the one contact pole of the switch with soldering lug 46, extends between two electrically conductive interconnected contacts 42 which form the other contact pole of switch 30 connected to soldering lug 44.

If no paper sheet is in the magazine, lever 32 is pivoted under the action of spring 48 into the position shown in solid lines in FIG. 1 and represented in FIG. 3. In this position arm 36 of lever 32 extends to the front past pressure plate 22. Projection 39 of lever 32 does not make contact with contact tongue 40, so that this tongue rests elastically on the one contact 42. Switch 30 is closed, therewith signaling that the device is not operational.

If, on the other hand, paper sheets are in the magazine and are being pressed by pressure plate 22 against separating roller 20, these sheets press arm 36 of lever 32 against the force of spring 48 back into the plane of pressure plate 22. In this position projection 39 makes contact with contact tongue 40 and lifts it off of the one contact 42 against its elastic restablishing force. Thus, contact tongue 40 is located between contacts 42 without touching them. Thus, switch 30 is open and indicates that the device is ready to operate.

If pressure plate 22 is pivoted away from separating rollers 20 and catches in the position shown in dotted lines in FIG. 1, the second arm 38 of lever 32 strikes profile 14 and is pressed by this profile 14 against pressure plate 22. This causes lever 32 to pivot into its other end position in which projection 39 presses contact tongue 40 against the second contact 42. Switch 30 is closed again and indicates that the device is not ready for operation.

The switch thus indicates in the same manner the lacking readiness for operation if no more paper is in the magazine and if pressure plate 22 does not press the paper stack against separating roller 20 in the manner required for a frictional engagement of separating roller 20. Switch 30 is open and the device can be put in operation for the feed of the individual sheets only if paper is in the magazine and is also being pressed against separating rollers 20 by pressure plate 22.

I claim:

1. A device for feeding individual sheets to an office machine having a frame which can be put into operation only if sheets are present in a magazine and only if a pressure plate is pressing said sheets against a sheet separating device comprising a magazine for receiving stacked sheets, a separating device which catches a first sheet of the stack, a movable mounted pressure plate which rests against the back of said stack under force and presses it against said separating device, characterized in that a first and a second switch are united in one switch which is located on the rear of said pressure plate and comprises a lever for actuation which extends through the pressure plate and makes contact with the stack, said lever having another portion which contacts a stop on the frame when the plate is completely moved away from the separating device.

2. Device according to claim 1, characterized in that said lever is a pivotably mounted two-armed lever wherein one arm extends through the pressure plate and a second arm makes contact with the stop.

3. Device according to claim 2, characterized in that a contact tongue is provided as one contact of said switch which has a tongue which can be moved in such a manner during the pivot movement of said lever between two conductively connected contacts as the other contact pole of said switch that said contact tongue rests on the one contact when the one arm of the lever extends freely over said pressure plate and is in contact with another contact when another arm of the lever makes contact with the stop; said contact tongue being freely located between two contacts when the first arm of said lever is pressed back into the plane of said pressure plate by a stack of sheets resting on said pressure plate.

* * * * *